US005901926A

United States Patent [19]

Zheng

[11] Patent Number: 5,901,926

[45] Date of Patent: May 11, 1999

[54] COLLAPSIBLE FLYING STRUCTURES

[75] Inventor: Yu Zheng, Covina, Calif.

[73] Assignee: Patent Category Corp., Monrovia, Calif.

[21] Appl. No.: 08/908,325

[22] Filed: Aug. 7, 1997

[51] Int. Cl.[6] ..... B64C 31/06

[52] U.S. Cl. ..... 244/153 R; 446/34; 446/61; 446/62; D21/88

[58] Field of Search ..... 244/153 R–155 A, 244/13, 16; 446/34, 46, 61, 62, 67; 2/102.1; 135/117, 126, 130, 137; D21/85, 86, 88, 89

[56] References Cited

U.S. PATENT DOCUMENTS

| | | | |
|---|---|---|---|
| 1,092,303 | 4/1914 | Stippick | 244/153 R |
| 2,403,212 | 7/1946 | Concepcion | 244/153 R |
| 3,711,045 | 1/1973 | Holland, Jr. | 244/153 R |
| 3,918,663 | 11/1975 | Cornelison, Jr. | 244/153 R |
| 4,768,739 | 9/1988 | Schnee | 244/153 R |
| 4,815,681 | 3/1989 | Crowell | 244/153 R |
| 4,815,784 | 3/1989 | Zheng . | |
| 4,878,636 | 11/1989 | Mileti | 244/153 R |
| 5,213,289 | 5/1993 | Barresi | 244/153 R |
| 5,358,440 | 10/1994 | Zheng . | |
| 5,579,799 | 12/1996 | Zheng | 135/126 |
| 5,598,988 | 2/1997 | Bukur | 244/153 A |
| 5,657,490 | 8/1997 | Edmark | 244/153 R |

FOREIGN PATENT DOCUMENTS

| | | | |
|---|---|---|---|
| 8901362 | 12/1990 | Netherlands | 244/153 R |
| 569841 | 6/1945 | United Kingdom | 244/153 R |

*Primary Examiner*—Galen L. Barefoot
*Attorney, Agent, or Firm*—Raymond Sun

[57] ABSTRACT

A collapsible flying structure includes an enclosed resilient frame member having a folded and an unfolded orientation, a panel covering the resilient frame member to form the flying structure when the frame member is in the unfolded orientation, and a control string coupled to the panel for controlling the flight of the flying structure. The frame member and panel may be twisted and folded to form a plurality of concentric loops and panels in the folded orientation of the frame member to substantially reduce the size of the flying structure.

28 Claims, 13 Drawing Sheets

COLLAPSIBLE FLYING STRUCTURES

BACKGROUND OF THE INVENTION

1. Field of the Invention

The present invention relates to collapsible structures, and in particular, to collapsible flying structures which may be provided in a variety of shapes and sizes. The collapsible flying structures may be twisted and folded to reduce the overall size of the structures to facilitate convenient storage and use.

2. Description of the Prior Art

Flying kites is a popular past-time that is enjoyed by many, including both adults and children. Kites are being provided in many different shapes and sizes, bearing a large variety of designs and colors. Larger kites are very beautiful when in full flight, and are often admired for their beauty and grace when they flow in the wind. Larger kites are also easier to fly, and can be visible from a further distance. On the other hand, smaller kites are often more difficult to fly, and are less visible than larger kites.

Unfortunately, one problem that is encountered by all kites is that their large size makes them very inconvenient to store, and to transport from one location to another. The irony is that kite-flying is best suited in locations that are relatively open, without many trees, buildings, telephone poles, and other structures and objects that would obstruct the flight of the kite. As a result, most people living in cities will need to carry a large and bulky kite in a vehicle to an open location, which is often outside a metropolitan area. Although some kites have fabric portions that can be folded, the skeleton of the kite which provides structural support and stability is still necessarily large and takes up much space, making them inconvenient to transport in buses or smaller vehicles. In addition, the large size of these kites makes them inconvenient to store in smaller homes where precious storage space is scarce. Thus, the storage and transportion problems associated with the large sizes of conventional kites often deter new potential hobbyists from taking up the hobby, and take away much of the fun and enjoyment from kite-flying enthusiasts.

Thus, there still remains a need for a flying structure, such as a kite, that preserves all the beauty, flight and enjoyment of conventional kites, while providing the hobbyist with convenience in use, storage and transportation. There is also a need for a flying structure, such as a kite, that provides increased variety in use which will enhance the entertainment and recreation value of the flying structure.

SUMMARY OF THE DISCLOSURE

In order to accomplish the objects of the present invention, the collapsible flying structure according to the present invention includes an enclosed resilient frame member having a folded and an unfolded orientation, a panel covering the resilient frame member to form the flying structure when the frame member is in the unfolded orientation, and a control string coupled to the panel for controlling the flight of the flying structure. The frame member and panel may be twisted and folded to form a plurality of concentric loops and panels in the folded orientation of the frame member to substantially reduce the size of the flying structure.

A frame retaining sleeve may be provided for housing the frame member, with the panel attached to the frame retaining sleeve. At least one opening may be defined between the panel and the frame retaining sleeve of the frame member.

The structure further includes at least one control panel attached to the panel and coupling the control string with the panel.

In one embodiment of the present embodiment, one of the control panels includes an enclosed resilient frame member having a folded and an unfolded orientation, with the control panel substantially covering the resilient frame member when the frame member is in the unfolded orientation.

In another embodiment of the present invention, the structure further includes an enclosure attached to the panel, the enclosure having two side walls attached to the panel, and a bottom wall attached to the two side walls. The structure further includes at least one opening provided on the panel and communicating with the enclosure.

In yet another embodiment of the present invention, the flying structure includes a second structure that also has an enclosed resilient frame member, and a panel covering the resilient frame member. The flying structure further includes a connector for connecting the first and second structures. The first structure may be placed on top of the second structure when their frame members are in the unfolded orientation to form a stack of first and second structures, and the frame members and panels of the stack of first and second structures may be twisted and folded to form a plurality of concentric loops and panels in the folded orientation of the frame members to substantially reduce the sizes of the first and second structures. In some embodiments, the connector operates as a hinge to allow the first structure to be folded upon the second structure about the connector. In one embodiment, the connector is detachable so that the first and second structures can be separated. In another embodiment, the connector is a connector piece having a first end attached to the first structure and a second end attached to the second structure. In yet another embodiment, the connector includes a stitching that is applied to the frame retaining sleeves of the first and second panels. In a further embodiment, the connector includes a plurality of threads attaching the panels of the first and second structures so that a space is defined between the panels of the first and second structures when the flying structure is in use.

In a further embodiment of the present invention, the flying structure further includes a third structure that also has an enclosed resilient frame member, a panel covering the resilient frame member, a first side and a second side. The first side of the third structure is coupled to the panel of the first structure, and the second side of the third structure is coupled to the panel of the second structure. The third structure may be positioned generally perpendicular to the first and second structures. In addition, at least one of the first and second sides is removably attached to the panel of one of the first structure or the second structure.

In a further embodiment of the present invention, the flying structure has at least first, second and third structures, each having an enclosed resilient frame member, a panel covering the resilient frame member, a first side and a second side. The first side of each of the structures is hingedly connected with the second side of another of the structures so that all the structures are connected together to form an enclosed space. Each structure may be placed on top of another structure when their frame members are in the unfolded orientation to form a stack of structures, and the frame members and panels of the stack of structures may be twisted and folded to form a plurality of concentric loops and panels in the folded orientation of the frame members to substantially reduce the sizes of the structures. At least one opening may be provided on one of the panels to communicate air to the enclosed space.

The collapsible flying structures according to the present invention are convenient for use since they are easily and quickly folded and collapsed into a smaller size for transportation and storage. The ability to fold and collapse the collapsible flying structures of the present invention allow these flying structures to be provided in larger sizes and different configurations, colors and designs, thereby rendering them easier to fly and increasing the variety and location of use afforded to the user.

DETAILED DESCRIPTION OF THE PREFERRED EMBODIMENTS

Figures 1, 2:
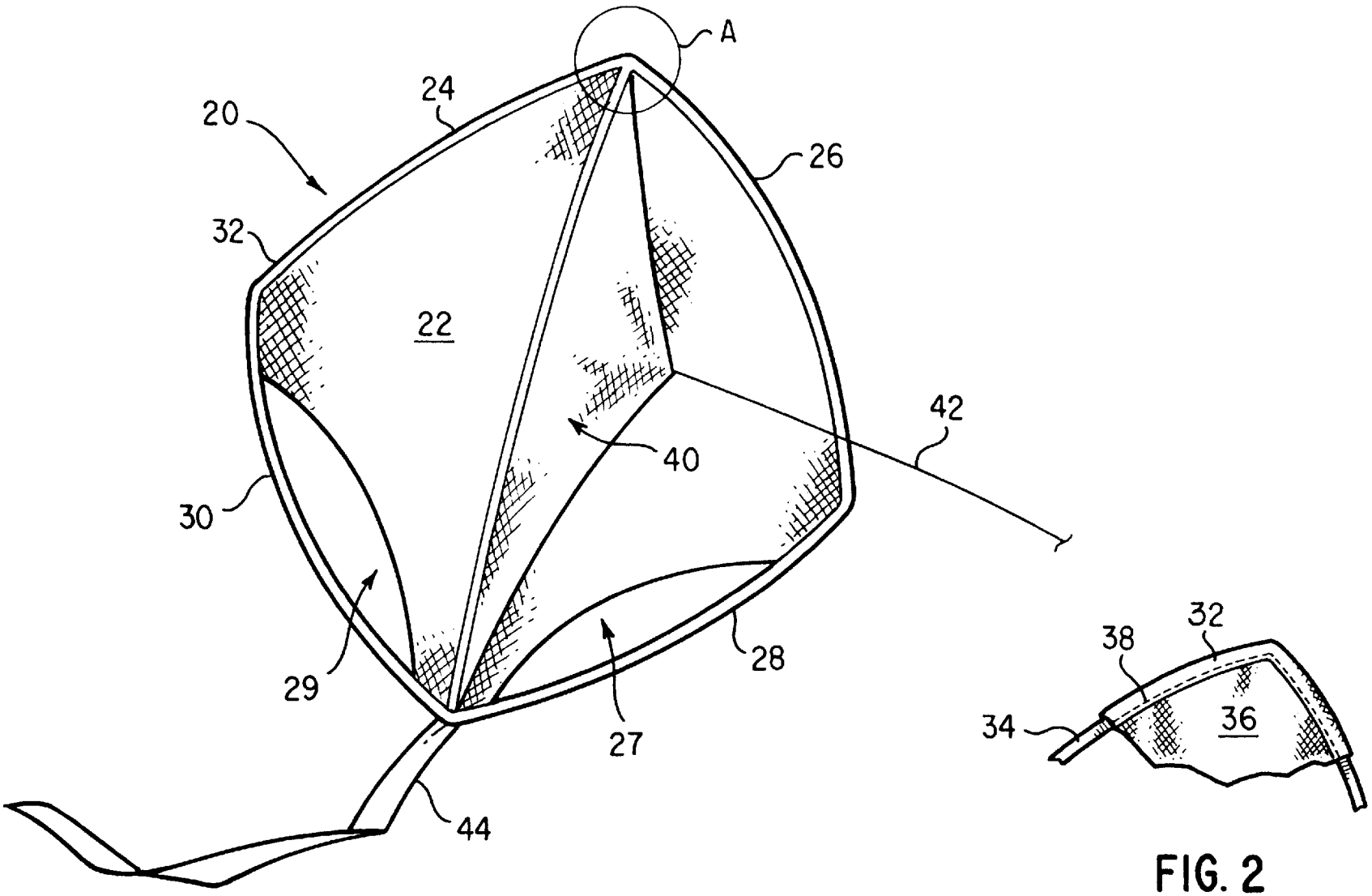
FIG. 1 is a perspective view of a collapsible flying structure according to a first preferred embodiment of the present invention shown in use in its expanded configuration.
FIG. 2 is a partial cut-away view of the section A of the structure of FIG. 1 illustrating a frame member retained within a sleeve.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides collapsible flying structures that can assume an expanded configuration and a collapsed configuration, and which can be twisted and folded from the expanded configuration to reduce the overall size of the flying structure in the collapsed configuration. The collapsible flying structures are each supported by at least one support frame having a panel substantially spanning the support frame in a taut fashion.

A first embodiment of the present invention is illustrated in connection with FIGS. 1 and 2. A collapsible flying structure 20 is made up of a panel 22 having four sides 24, 26, 28 and 30 that define a generally square or diamond configuration. The panel 22 has a continuous frame retaining sleeve 32 provided along and traversing the edges of two of its four sides 24 and 26, and traversing a part of the edges of the other two sides 28 and 30. As a result, two openings 27 and 29 are defined between the panel 22 and the sides 28 and 30, respectively. These openings 27, 29 are provided to allow air to flow therethrough in order to help get the flying structure 20 to get airborne.

A continuous frame member 34 is retained or held within the frame retaining sleeve 32 to support the panel 22. The continuous frame member 34 may be provided as one continuous enclosed loop, or may be a strip of material connected at both ends to form an enclosed loop. The continuous frame member 34 is preferably formed of flexible coilable steel, although other materials such as plastics may also be used. The frame member 34 should be made of a material which is relatively strong and yet is flexible and resilient to a sufficient degree to allow it to be coiled. Thus, the frame member 34 is capable of assuming two positions, an open or expanded position such as shown in FIG. 1, or a folded position in which the frame member 34 is collapsed into a size which is much smaller than its open position (see FIG. 3D).

The frame member 34 may be merely retained within the frame retaining sleeve 32 without being connected thereto. Alternatively, the frame retaining sleeve 32 may be mechanically fastened, stitched, fused, or glued to the frame member 34 to retain the frame member 34 in position.

The panel 22 is defined by a sheet material 36 which extends across the panel 22, and is held taut by the frame members 34 when in the frame member's 34 open or expanded position. The term "sheet material" is to be given its broadest meaning and should be made from strong, foldable, flexible and lightweight materials and may include vinyl, fabrics, spunbond materials (such as tyvel), woven fabrics, sheet fabrics or even films.

The sheet material 36 and the frame retaining sleeve 32 may be provided separate and then stitched together along stitch line 38, or they may be attached together by other conventional mechanisms and methods. Alternatively, the sleeve 32 may be made from an extension of the sheet material 36 by folding the peripheral edge of the sheet material 36 over the frame member 34 and then applying a stitch line (such as 38) to form the sleeve 32.

A generally triangular control panel 40 is provided along a central portion of the sheet material 36 of the panel 22. The control panel 40 can be provided with the same material as the sheet material 36. The control panel 40 provides channels or spaced regions on either side thereof through which the wind may flow, thereby helping to promote the flight of the flying structure 20. The control panel 40 also helps to control the flying structure 20 in an upward orientation when it gets airborne off the ground, and to direct the flying structure 20 in different directions. In the embodiment illustrated in FIG. 1, the control panel 40 extends entirely across the central portion of the panel 22 between two opposing points of the frame retaining sleeve 32 to provide support along the entire central portion. However, as illustrated in the other embodiments below, the control panel 40 does not necessarily need to extend entirely across the panel 22 between two opposing points of the sleeve 32. One end of a control string or rope 42 is attached to the control panel 40 to allow the user to control the flying structure 20. A grip or handle bar (not shown) may be attached to the other end of the control string 42 for the user to grip or hold in controlling the flying structure 20.

Ribbons 44 may be provided along the peripheral edge (e.g., along the frame retaining sleeve 32) of the flying structure 20 to enhance the aesthetic appearance of the structure 20. In addition, one or both sides of the panel 22, and of the panels in any of the embodiments illustrated below, may be provided with a wide variety of decals, designs, colors, accessories (e.g., whistles) and patterns for selection by the user.

Figure 3A:
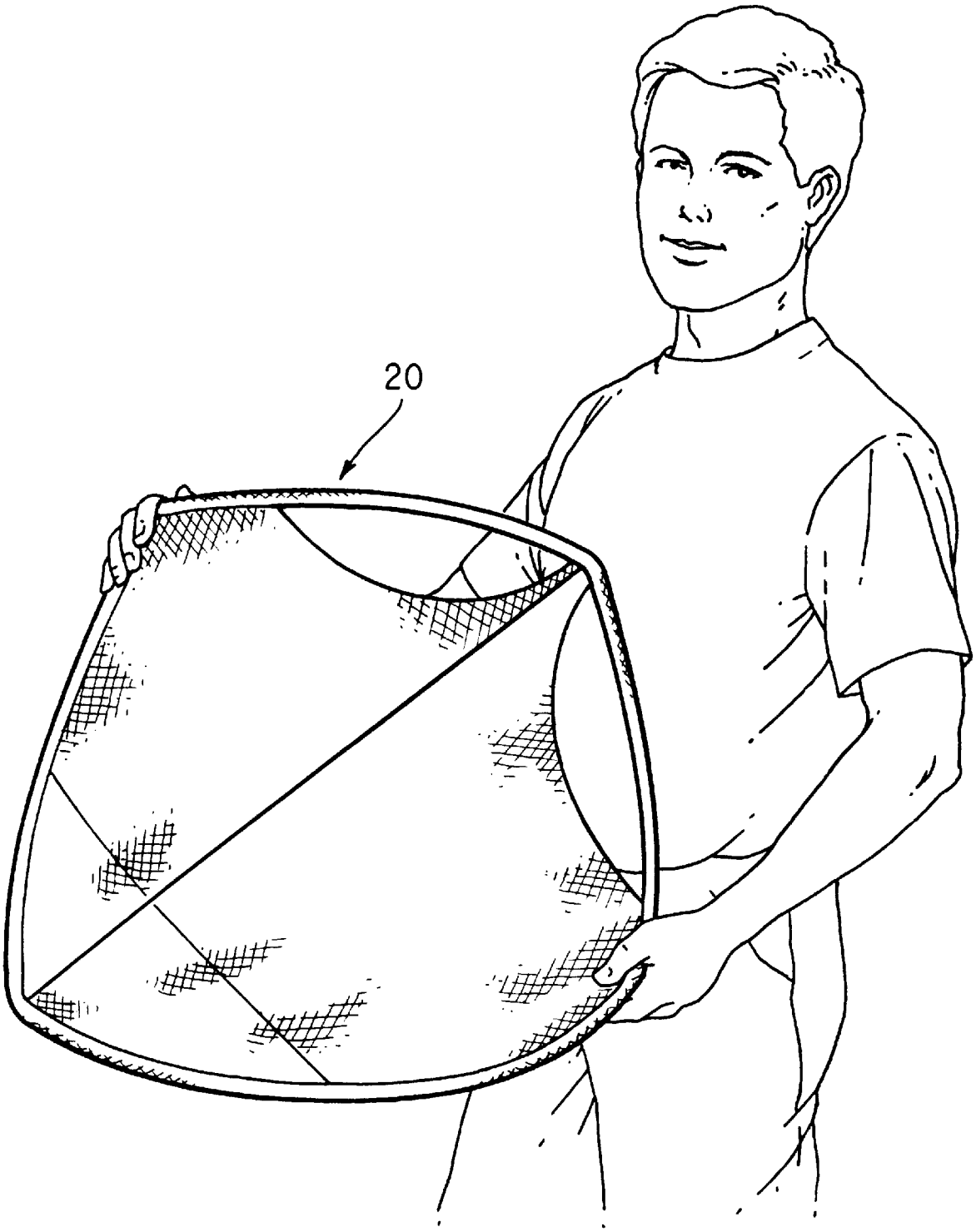
FIGS. 3(A) through 3(D) illustrate how the flying structure of FIG. 1 may be twisted and folded for compact storage.
Figure 3B:
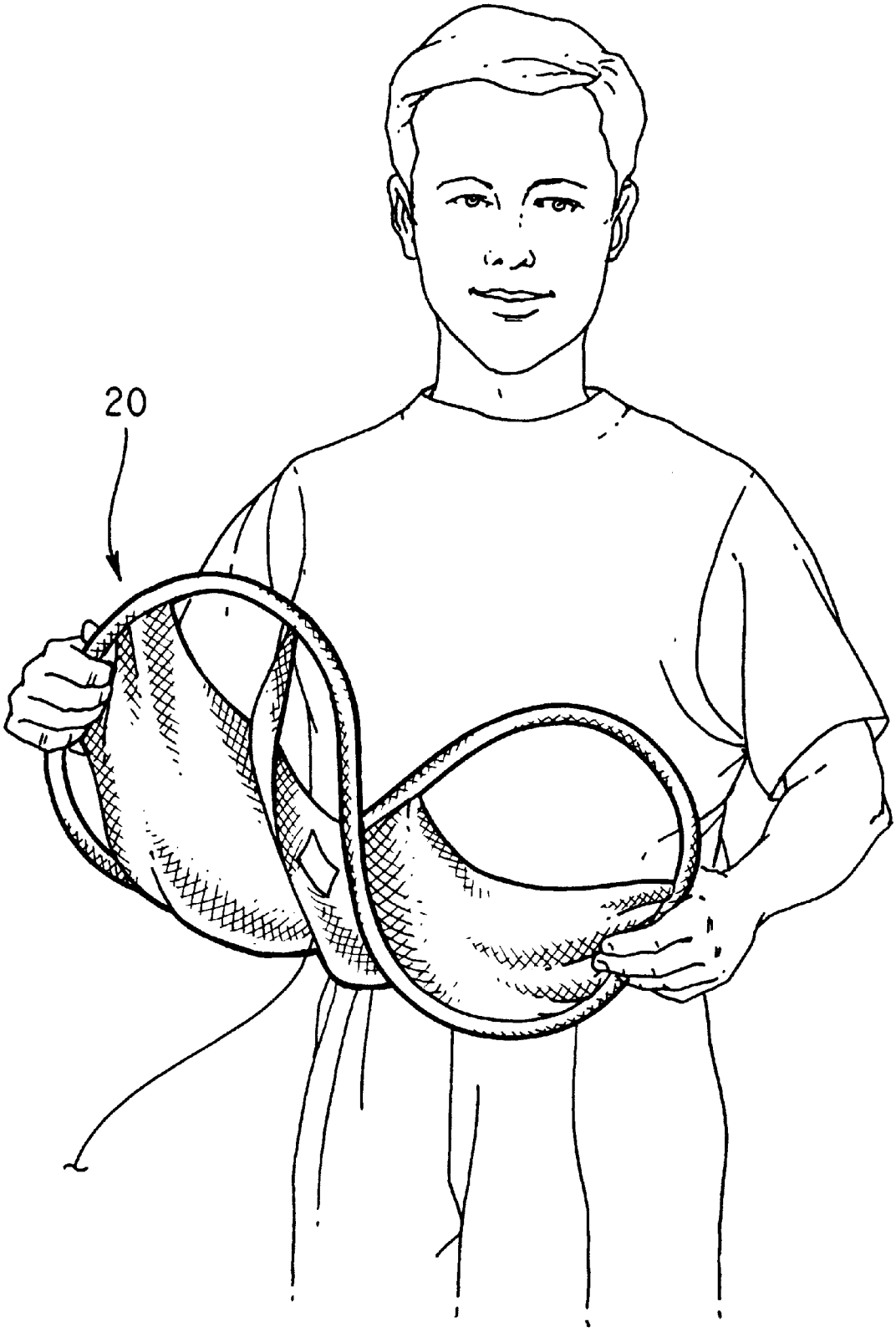
Figure 3C:
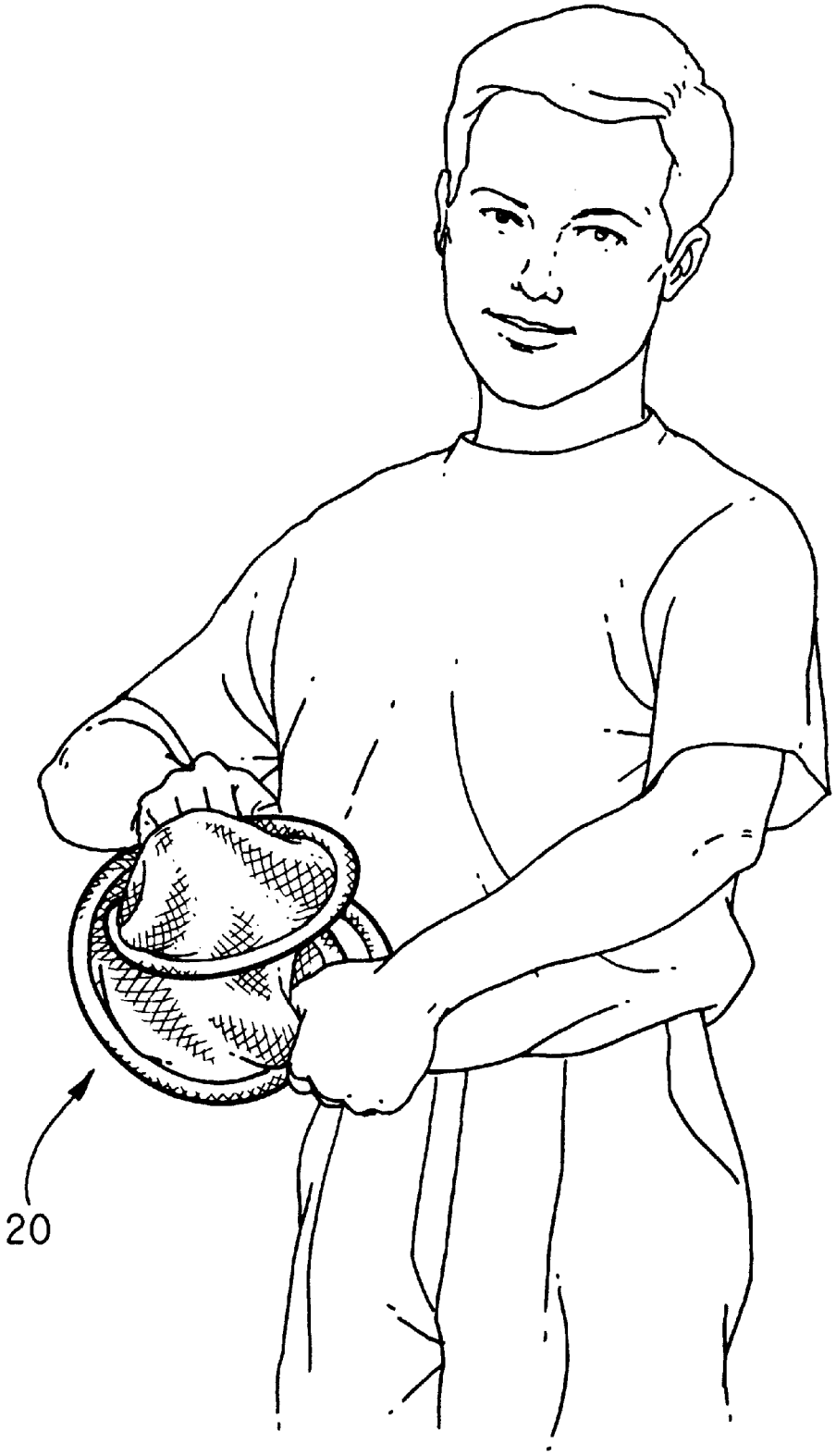
Figure 3D:
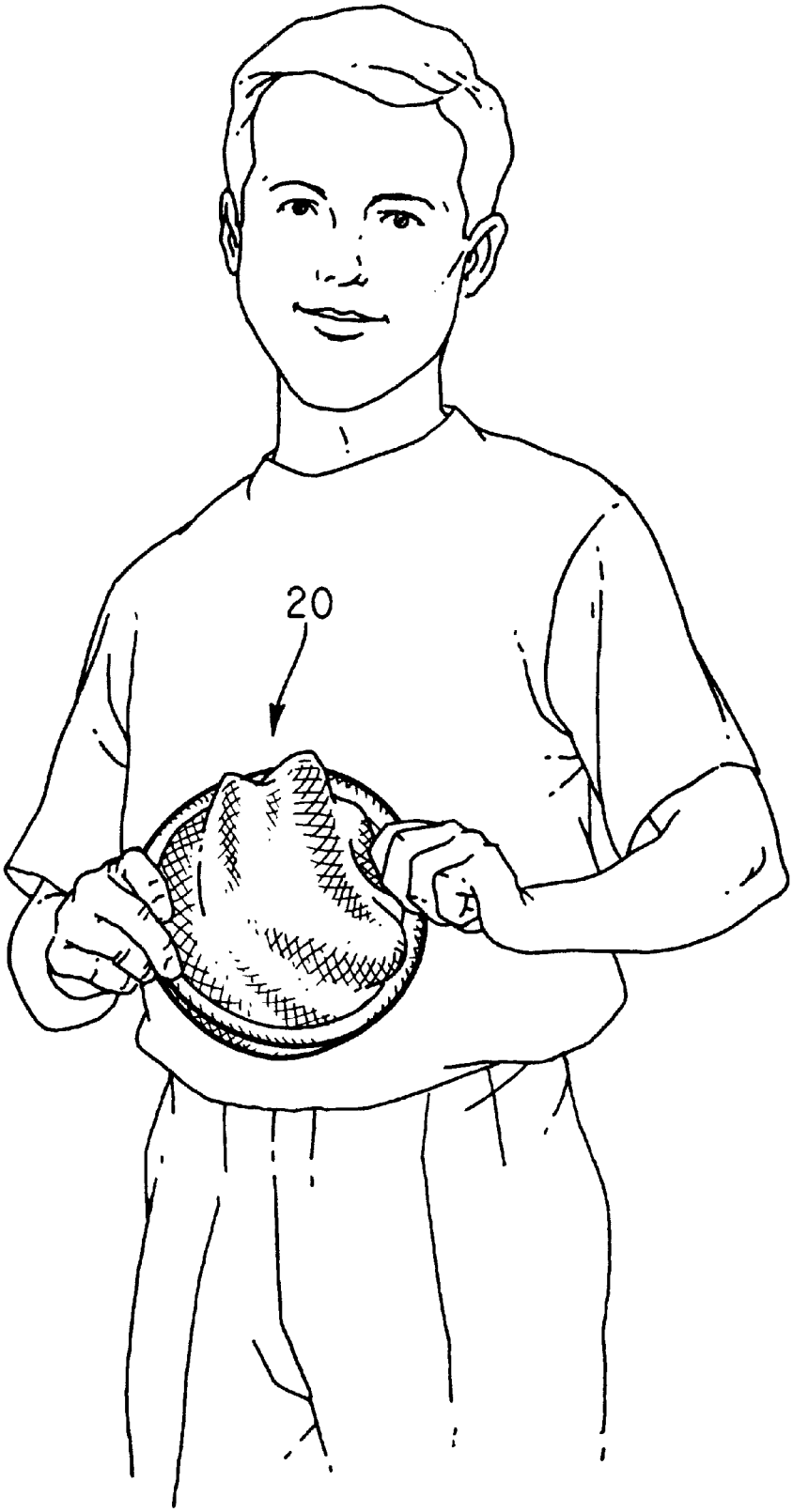

FIGS. 3A through 3D describe the steps for folding and collapsing the flying structure 20 into a compact configuration for transportation and storage. In the first step shown in FIG. 3A, each of the opposite borders of the flying structure 20 is held by a separate hand. The opposite borders are then turned in opposite directions to form a "Figure 8" shape (see FIG. 3B). Further twisting and folding (see FIG. 3C) causes the frame member 34 and panel 22 to form a plurality of concentric frame members and panels. FIG. 3D shows the frame member 34 and panel 22 collapsed on each other to provide for a small essentially compact configuration having a plurality of concentric frame members and layers of the panel so that the collapsed flying structure 20 has a size which is a fraction of the size of the initial flying structure 20. During the folding and collapsing steps of FIGS. 3A–3D, the control panel 40 is folded against the panel 22, and is folded and collapsed together with the panel 22. To open the flying structure 20 to its expanded configuration, the collapsed frame member 34 and its panel 22 are unfolded, and the springy nature and natural bias of the frame member 34 will cause the flying structure 20 to spring open to the expanded configuration.

The flying structure 20 in FIG. 1 is illustrated as having a basic configuration. The flying structures of the present invention can be provided in a variety of external shapes and sizes. The embodiments below illustrate certain non-limiting examples of these flying structures having different shapes and sizes.

Figure 4:
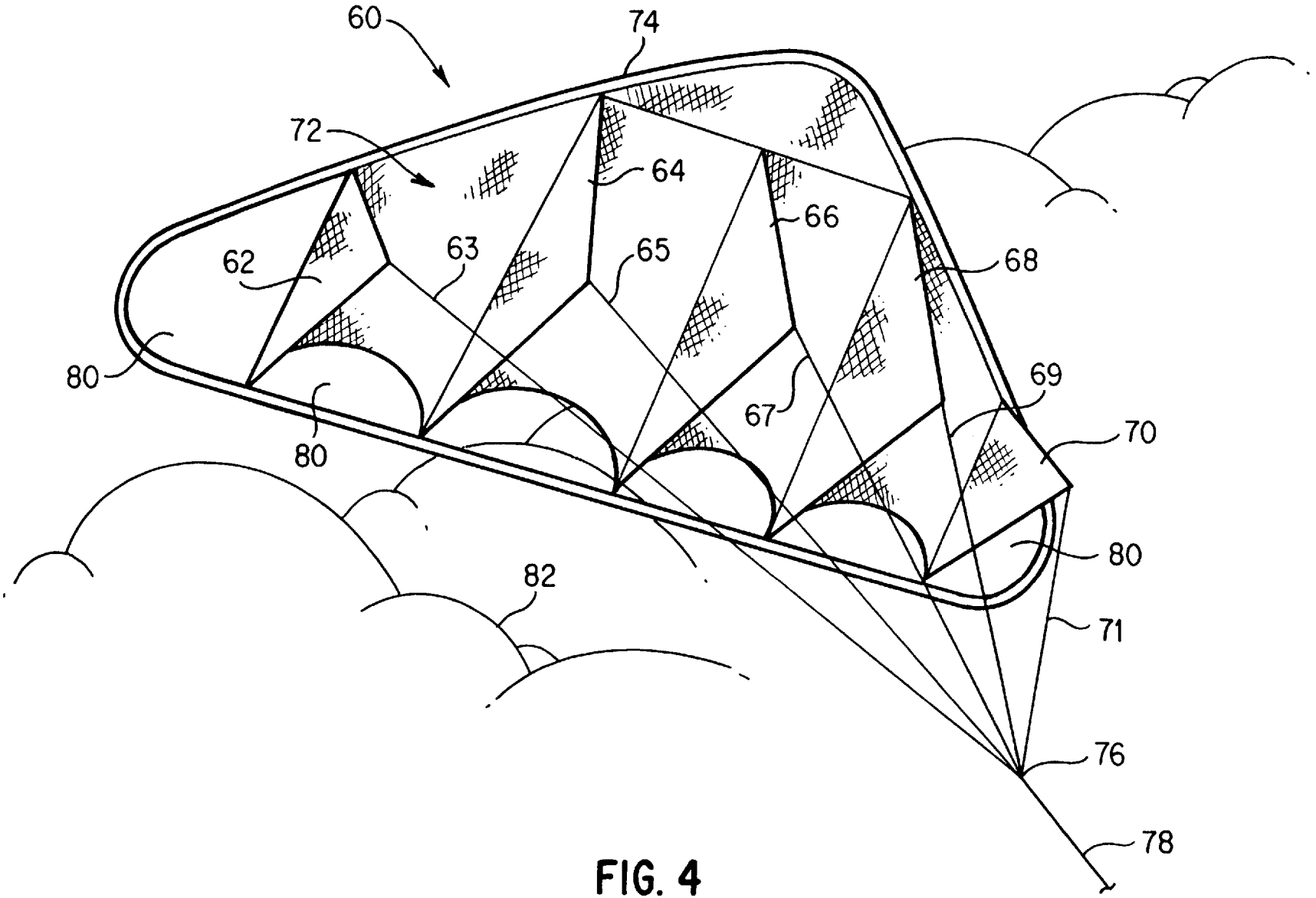
FIG. 4 is a perspective view of a collapsible flying structure according to a second preferred embodiment of the present invention shown in use in its expanded configuration.

A second preferred embodiment of the present invention is shown in FIG. 4. The flying structure 60 is similar to flying structure 20 except that flying structure 60 has a generally triangular configuration and is provided with five control panels 62, 64, 66, 68 and 70. Except for control panel 66, the other four control panels 62, 64, 68 and 70 extend entirely across the panel 72 between two opposing points of the frame retaining sleeve 74. Five control strings 63, 65, 67, 69 and 71 are attached at one end to the control panels 62, 64, 66, 68 and 70, respectively. The other end of the control strings 63, 65, 67, 69 and 71 may be tied together or otherwise connected at 76 to one end of a combined control string 78. A plurality of openings 80 may be provided along the peripheral edge of the panel 72. One or more decorative ribbons 82 may also be attached to the panel 72 or the frame retaining sleeve 74. The flying structure 60 may be folded and collapsed according to the same method described above in FIGS. 3A–3D, and may be opened to the expanded configuration using the method described above in connection with flying structure 20.

Figure 5:
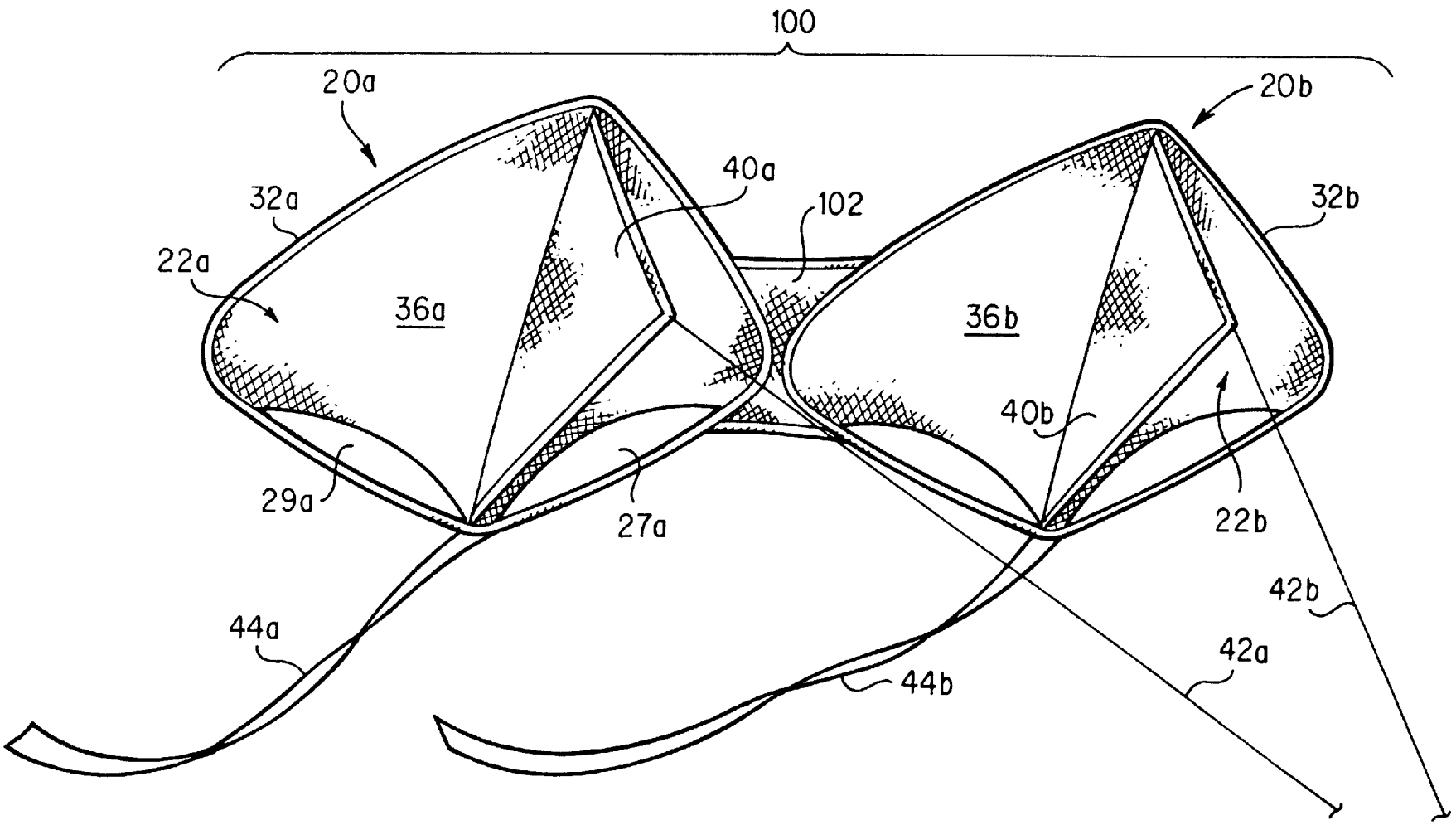
FIG. 5 is a perspective view of a collapsible flying structure according to a third preferred embodiment of the present invention shown in use in its expanded configuration.

Referring now to FIG. 5, a third embodiment of the present invention provides a flying structure 100 made of two structures 20*a* and 20*b* that are each identical to the flying structure 20. A connector piece 102 operates to connect the two structures 20*a* and 20*b*. The connection can be made at any part of either structure 20*a* and 20*b*. For example, the connection in FIG. 5 is illustrated as being between two adjacent corners of the structures 20*a* and 20*b* in a manner in which the two structures 20*a* and 20*b* are horizontally aligned when placed on a flat surface in a side-by-side manner. The connector piece 102 may be connected to the structures 20*a* and 20*b* by any secure connection mechanism which is strong enough to prevent separation of the connector piece 102 from the structures 20*a* and 20*b* during use. For example, the connector piece 102 may be stitched to the sheet material 36*a* and 36*b* of the structures 20*a* and 20*b*, or to the frame retaining sleeves 32*a* and 32*b* of the structures 20*a* and 20*b*, to provide a non-detachable connection. Alternatively, a detachable or removable connection can be provided by using connection mechanisms such as opposing Velcro™ pads, hooks, fasteners, buttons, snap-fit engagements, loops, snap buckles, zippers or ties. The connector piece 102 may be made of the same material as the sheet material 36.

Non-limiting alternatives to the connector piece 102 can be provided. For example, discrete connecting elements that can be used to connect the two structures 20*a*, 20*b* include one or more thin connecting straps, one or more rope or thread segments, zippers, tie members, opposing hooks, opposing fasteners, buttons, snap-fit engagements, loops, or snap buckles. All these connecting elements operate in a similar manner as the connector piece 102, by providing opposite ends that are attached to the two different structures 20*a*, 20*b*. In addition, many of these connecting elements are also capable of operating as a hinge to allow one structure 20*a* or 20*b* to be folded upon the other structure 20*b* or 20*a*, respectively.

As a further example, the two structures 20*a*, 20*b* can be directly connected to each other by stitching or otherwise connecting the frame retaining sleeves 32*a* and 32*b* of the two structures 20*a*, 20*b*. When connected in this manner, the stitching will operate as a hinge to allow one structure 20*a* or 20*b* to be folded upon the other structure 20*b* or 20*a*, respectively.

Control strings 42*a* and 42*b* each has one end that is attached to the control panels 40*a* and 40*b*, respectively, of the structures 20*a* and 20*b*, respectively. The other end of the control strings 42*a*, 42*b* may be controlled separately by the user, or may be connected together to one combined control string, such as the combined control string 78 illustrated in FIG. 4.

To fold and collapse the flying structure 100, one structure 20*a* or 20*b* may be folded upon the other structure 20*b* or 20*a*, respectively, about the connector piece 102 which acts as a hinge so that the structures 20*a* and 20*b* are placed one on top of the other. The combined structures 20*a* and 20*b* can then be folded and collapsed according to the method described above in FIGS. 3A–3D. Alternatively, if the connections between connector piece 102 and the structures 20*a* and 20*b* are detachable, it is also possible to remove the connector piece 102 from both structures 20*a*, 20*b*, and then place the separated structures 20*a*, 20*b* one on top of the other. The connector piece 102 can be sandwiched between the two structures 20*a*, 20*b*, or placed on top of the stack of structures 20*a*, 20*b*, and the combined structures 20*a*, 20*b* and connector piece 102 can then be folded and collapsed according to the method described above in FIGS. 3A–3D.

Therefore, providing a detachable connector piece 102 allows the user to fold and collapse the flying structure 100 using one of two methods. If a non-hingeable connecting element is used, the separate structures 20*a*, 20*b* must be detached and separated before the folding and collapsing steps.

To open and assemble the flying structure 100, the collapsed stack of structures 20*a*, 20*b* is opened in the manner described above so that both structures 20*a*, 20*b* are opened to their expanded configurations. One structure 20*a* or 20*b* is then folded away from the other structure 20*b* or 20*a* about the hinge, and the flying structure 100 is ready for use. If the connector piece 102 has been detached, then the connector piece 102 will need to be attached to the structures 20*a*, 20*b*, if the user so desires. Otherwise, the user can also fly one of the structures 20*a* or 20*b* alone, without using the other structure 20*b* or 20*a*, respectively.

Thus, the flying structure 100 provides variety in use, since it can be used in many ways. The user can fly the combined flying structure 100, or separate the two structures 20*a* and 20*b* and fly each or both of them separately. The flying structure 100 can also be folded, collapsed and stored with the connector piece 102 attached to the structures 20*a*, 20*b*, or with the connector piece 102 removed, thereby providing flexibility in use and storage.

Figure 6:
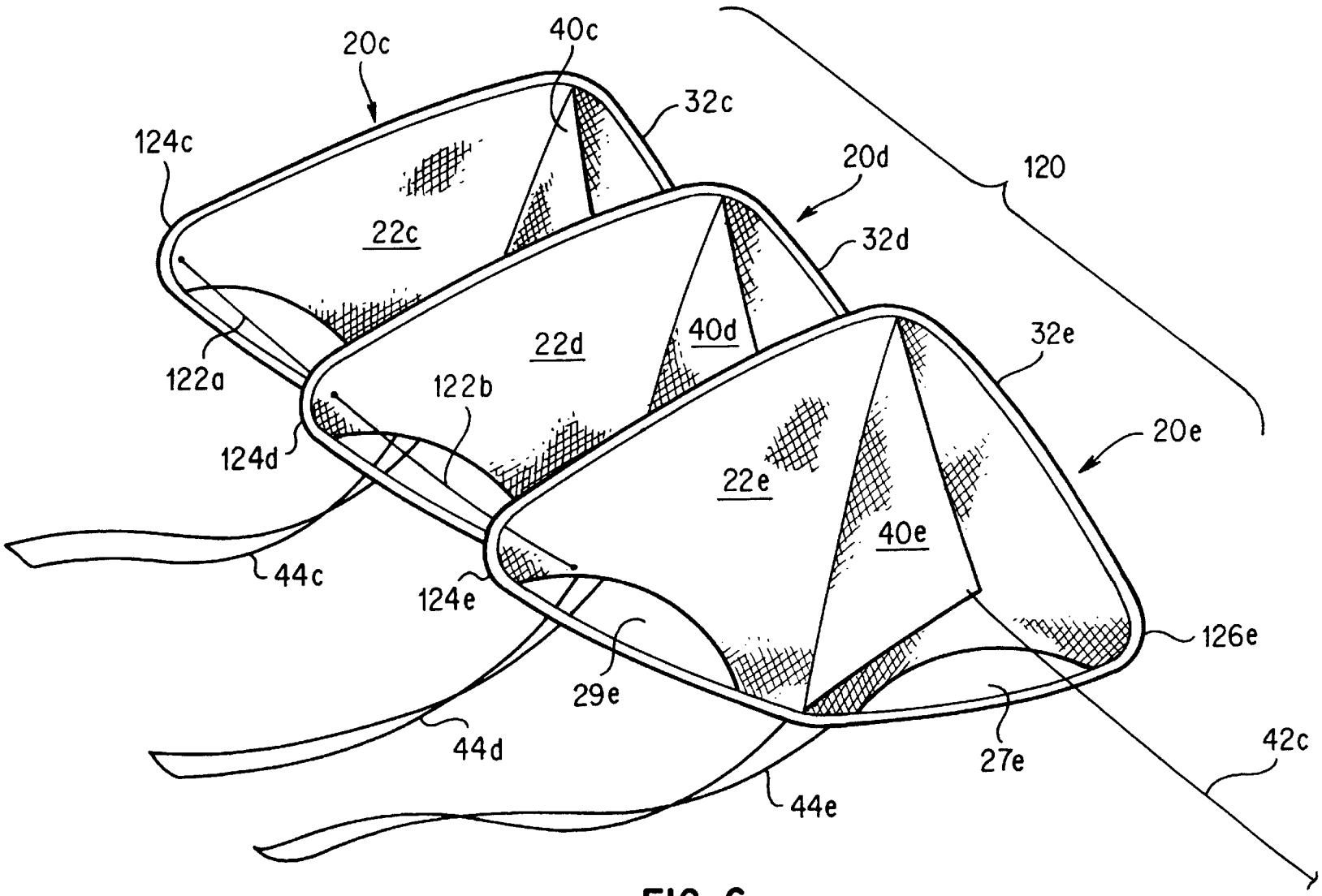
FIG. 6 is a perspective view of a collapsible flying structure according to a fourth preferred embodiment of the present invention shown in use in its expanded configuration.

It is also possible to connect more than two of the structures 20 of FIG. 1 together to form a multi-structured flying kite or structure. Referring to FIG. 6, the flying structure 120 includes three structures 20*c*, 20*d* and 20*e* that are each identical to the flying structure 20. The three separate structures 20*c*, 20*d*, 20*e* are connected together by threads or strings. Specifically, a first thread 122*a* connects the panel 22*c* or frame retaining sleeve 32*c* at a left-most corner 124*c* of the structure 20*c* with the panel 22*d* or frame retaining sleeve 32*d* at a left-most corner 124*d* of the structure 20*d*, and a second thread 122*b* connects the panel 22*e* or frame retaining sleeve 32*e* at a left-most corner 124*e* of the structure 20*e* with the panel 22*d* or frame retaining sleeve 32*d* at the left-most corner 124*d* of the structure 20*d*. Similar threads (not shown) are used to connect the right-most corners (right-most corner 126*e* is illustrated) of the structures 20*c*, 20*d* and 20*e*. These threads 122*a*, 122*b* function to space the three structures 20*c*, 20*d* and 20*e* apart from each other when the flying structure 120 is being used, so that air can flow through the spaces between the three structures 20*c*, 20*d*, 20*e*. The threads 122*a* and 122*b* can also be detachable, so that the three structures 20*c*, 20*d*, 20*e* can be separated into three separate flying structures, or one flying structure having two of the three structures 20*c*, 20*d*, 20*e*. This flexibility increases the variety of use, and enhances the entertainment value of the flying structure 120. In addition, the control panels 40*c* and 40*d* can be removably attached (such as by the removable connection mechanisms described above) or permanently attached (such as by stitching) to the panels 22*d* and 22*e*, respectively.

To fold and collapse the flying structure 120 for storage and transportation, the three structures 20*c*, 20*d*, 20*e* are placed one on top of the other to create a stack of three structures 20*c*, 20*d*, 20*e*. Each control panel 40*c* and 40*d* can be folded or pressed against an adjacent panel 22*c*, 22*d* and 22*e*, or sandwiched between two of the panels 22*c*, 22*d*, 22*e*. If the user so desires, the threads 122*a*, 122*b* can be removed, the control panels 40*c* and 40*d* detached, and the structures 20*c*, 20*d*, 20*e* separated. The combined structures 20*c*, 20*d* and 20*e*can then be folded and collapsed according to the method described in FIGS. 3A–3D. To open and assemble the flying structure 120, the collapsed stack of structures 20*c*, 20*d*, 20*e* is opened in the manner described above so that the structures 20*c*, 20*d*, 20*e* are opened to their expanded configurations, and the flying structure 120 is ready for use. If the threads 122*a*, 122*b* and the control panels 40*c*, 40*d* have been detached, they will need to be re-attached to the structures 20*c*, 20*d*, 20*e*, if the user so desires.

Figure 7:
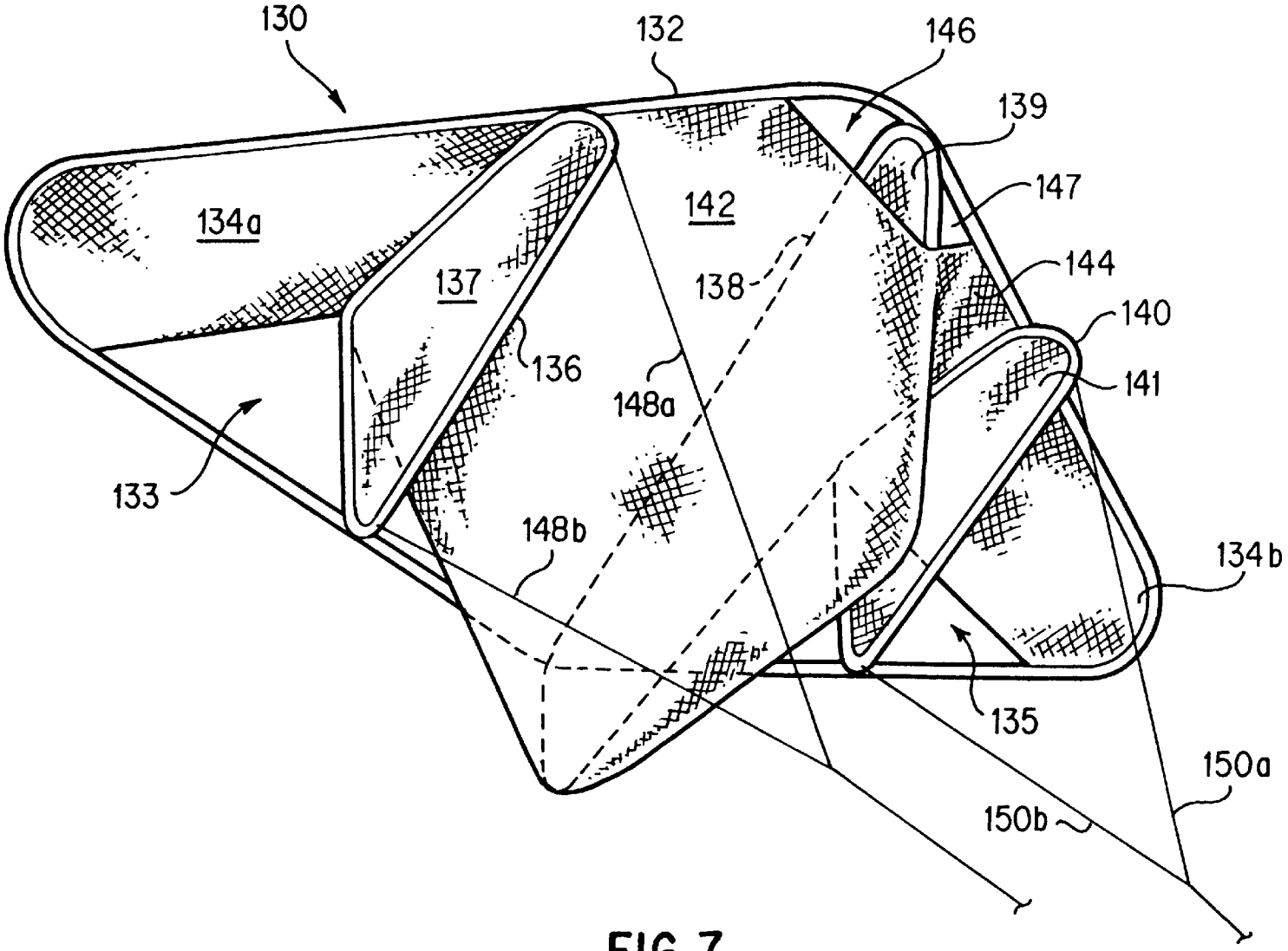
FIG. 7 is a perspective view of a collapsible flying structure according to a fifth preferred embodiment of the present invention shown in use in its expanded configuration.

The flying structures according to the present invention can also be provided with two or more frame members for each specific structure. An example is illustrated in FIG. 7, in which a flying structure 130 has a peripheral frame member 132 supporting two panels 134*a*, 134*b*, and further includes three additional frame members 136, 138, 140 that support three control panels 137, 139 and 141, respectively. These frame members 136, 138, 140 are provided in spaced-apart manner, with the frame retaining sleeves of these frame members 136, 138, 140 attached to the frame retaining sleeve of the frame member 132 by stitching or any other conventional connecting mechanism. Control panels 137 and 141 can be removably attached using one of the removable connection mechanisms described above. Panels 134*a*, 134*b* are attached to the frame retaining sleeves of the frame member 132 and the frame members 136 and 140, respectively, defining openings 133 and 135 between the frame member 132 and the panels 134*a* and 134*b*, respectively.

Two angled panels 142 and 144 may be attached to the frame retaining sleeves of the frame member 132 and one of the control panels (e.g., 139) so that the angled panels 142, 144 extend at an angle with respect to the plane defined by the frame member 132 when in its open or expanded configuration. The control panels 137, 139, 141 and the side panels 142, 144 are intended to perform the same functions as the control panel 40 described above. In particular, several wind channels are created by the configuration of the flying structure 130. For example, one wind channel 146 is defined between the panels 139 and 142, and another wind channel 147 is defined between the panels 139 and 144. Openings 133 and 135 also define wind channels to allow air to pass through. These wind channels help to enhance the flight and performance of the flying structure 130 since air fills or passes through these channels 146, 147, 133, 135 to help get the flying structure 130 airborne, and to maintain the shape and structural integrity of the flying structure 130 when it is airborne.

Control strings can be attached to selected control panels. For example, control strings 148*a* and 148*b* may be attached to one control panel 137, and control strings 150*a* and 150*b* may be attached to another control panel 141, while control panel 139 is not provided with any control strings.

The flying structure 130 can be folded and collapsed by folding and collapsing the frame member 132 and the panels 134*a*, 134*b*, 144, 146 using the same method described in FIGS. 3A–3D. The smaller frame members 136, 138 and 140 can be folded and collapsed along with the folding and collapsing the frame member 132. If the control panels 137 and 141 are removably attached to the frame retaining sleeve of frame member 132, they can be detached therefrom prior to the folding and collapsing of the frame member 132 and the panel 134, and either folded and collapsed separately, or stacked on top of the frame members 132 and 138 to be folded and collapsed together. To open the flying structure 130 back to the expanded configuration, the collapsed frame member 132 is unfolded, and the springy nature and natural bias of the frame members 132 and 138 will cause the flying structure 130 to spring open to the expanded configuration. The control panels 137 and 141 can be re-attached if they have been previously detached.

Figure 8:
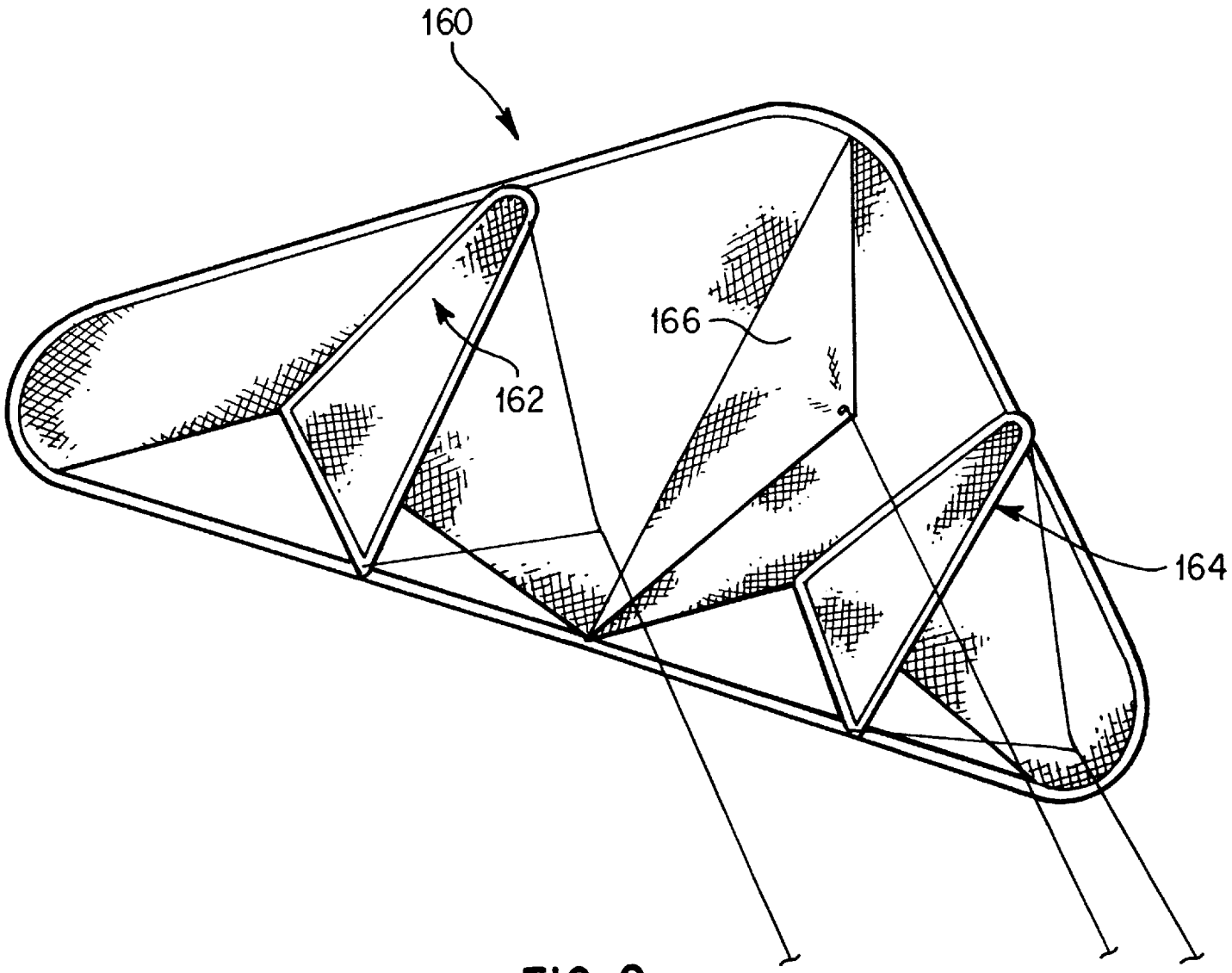
FIG. 8 is a perspective view of a collapsible flying structure according to a sixth preferred embodiment of the present invention shown in use in its expanded configuration.

It is also possible to provide some control panels with supporting frame members, and other control panels on the same flying structure without supporting frame members. For example, FIG. 8 illustrates a flying structure 160 that is similar in construction and operation to flying structures 60 and 130 of FIGS. 4 and 7, respectively. The flying structure 160 is provided with two control panels 162 and 164 which are supported with a frame member, and one control panel 166 which is not supported with a frame member.

Figure 9:
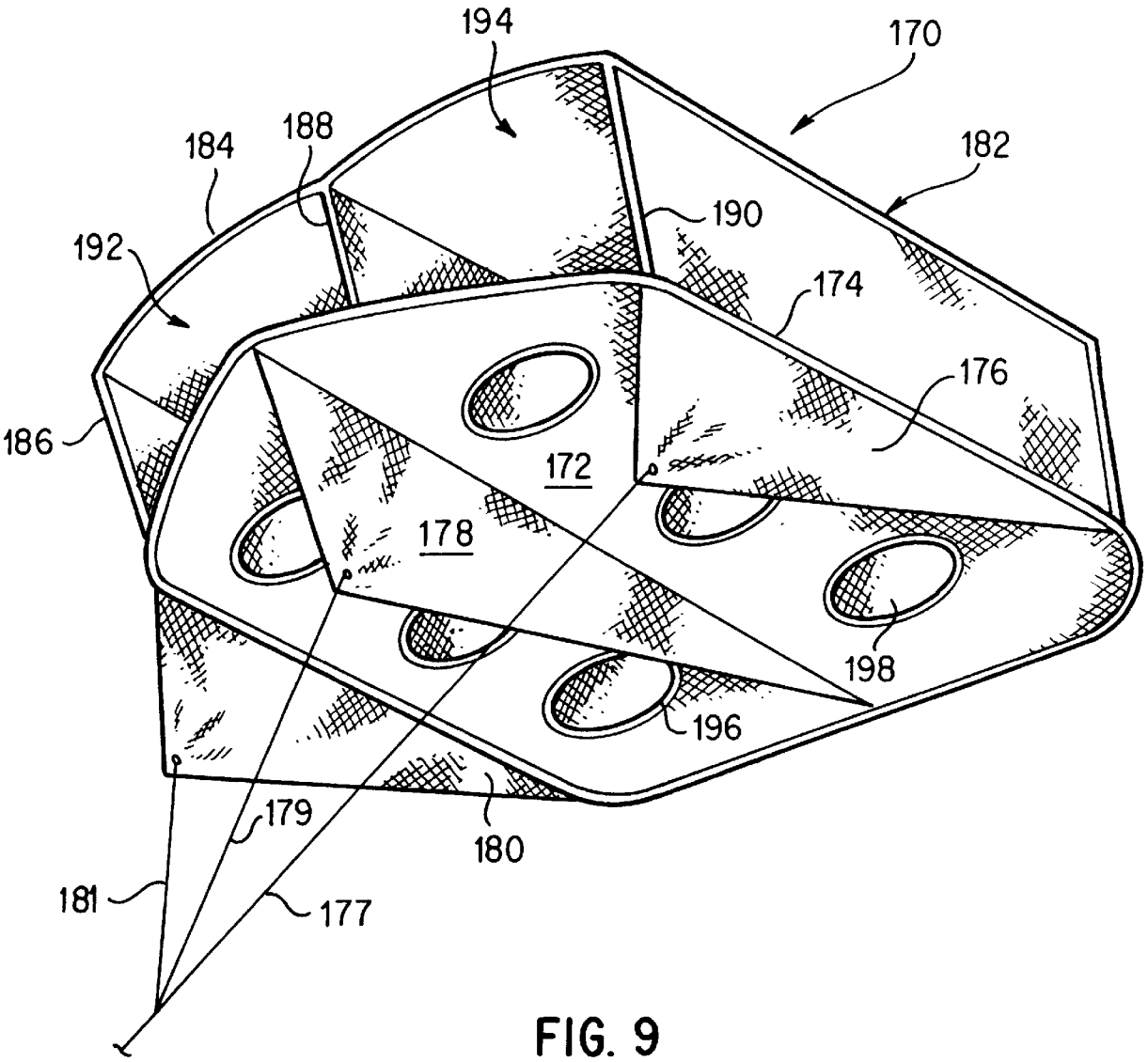
FIG. 9 is a perspective view of a collapsible flying structure according to a seventh preferred embodiment of the present invention shown in use in its expanded configuration.

FIG. 9 illustrates yet another flying structure 170 according to the present invention. The flying structure 170 is made up of a panel 172 with a continuous frame retaining sleeve 174 provided along and traversing its edges. A continuous frame member (not shown) is retained or held within the frame retaining sleeve 174 to support the panel 172. One side of the panel 172 is provided with three spaced-apart control panels 176, 178, 180. Although the control panels 176, 178, 180 are illustrated as not being supported by any frame members, it is also possible to provide frame members to support one or more of these control panels 176, 178, 180. Control strings 177, 179 and 181 are attached to the control panels 176, 178, 180, respectively.

A box-like enclosure 182 is attached to the side of the panel 172 opposite to that side which the control panels 176, 178, 180 are attached. The enclosure 182 is made of either a meshed material or one of the sheet materials used for the panel 22. The enclosure 182 has a bottom wall 184 and three side walls 186, 188 and 190 that define two separate compartments 192 and 194. The compartment 192 is defined by the side walls 186 and 188, the bottom wall 184, and the panel 172, while the compartment 194 is defined by the side walls 188 and 190, the bottom wall 184, and the panel 172. Thus, the central side wall 188 actually divides the enclosure 182 into the two compartments 192, 194. A first row of openings 196 are provided on the panel 172 along the first compartment 192 to allow air to flow into the first compartment 192. Similarly, a second row of openings 198 are provided on the panel 172 along the second compartment 194 to allow air to flow into the second compartment 194. Thus, air can be flowed into the compartments 192 and 194 during use to cause the flying structure 170 to get airborne and to float in the sky.

Those skilled in the art will appreciate that the dividing side wall 188 can be omitted so that only one compartment is provided in the enclosure 182.

To fold and collapse the flying structure 170, the walls 184, 186, 188 and 190 of the enclosure 182 are pressed against the panel 172. This can be easily accomplished because these walls 184, 186, 188 and 190 are made of a foldable and flexible material. The flying structure 170 can be twisted and folded according to the method illustrated in FIGS. 3A–3D to collapse the flying structure 170 into its collapsed configuration, with the walls 184, 186, 188 and 190 twisted and folded together with the panel 172.

To open the flying structure 170 back to the expanded configuration, the collapsed frame member and its panel 172 are unfolded, and the springy nature and natural bias of the frame member will cause the flying structure 170 to spring open to the expanded configuration. When the flying structure 170 is hoisted into the air, the wind will cause air to flow through the openings 196 and 198 into the compartments 192, 194, thereby forcing the bottom wall 184 away from the panel 172 to assume the configuration shown in FIG. 9.

Figure 10:
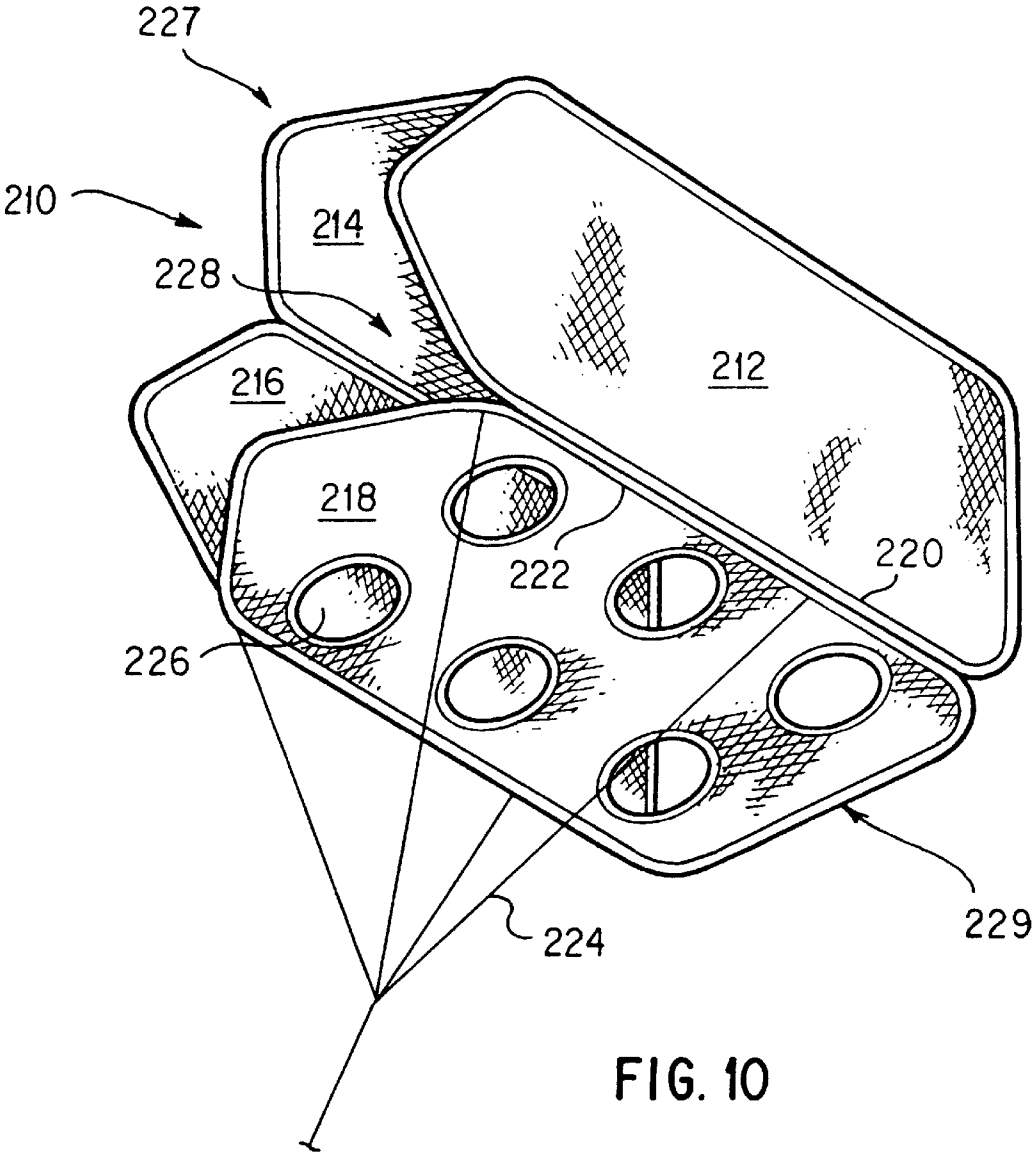
FIG. 10 is a perspective view of a collapsible flying structure according to a eighth preferred embodiment of the present invention shown in use in its expanded configuration.

FIG. 10 illustrates a flying structure 210 according to another embodiment of the present invention, which is made up of a plurality of panels and supporting frame members. The flying structure 210 is made up of four sets 212, 214, 216 and 218 of panels and supporting frame members. Each set of panel and supporting frame member has two opposing straight sides, each of these straight sides being hingedly attached to an adjacent straight side of an adjacent set of panel and supporting frame member to form an enclosed space 228 and to opposing open ends 227, 229 of the flying structure 210. The hinged connection can be a permanent connection, such as stitching the sides of two adjacent frame retaining sleeves (such as sleeves 220 and 222 of panel and frame member sets 212 and 218, respectively). Alternatively, the hinged connection can be a detachable connection, such as providing opposing Velcro™ pads, hooks, fasteners, buttons, snap-fit engagements, loops, snap buckles, zippers or ties along the sides of adjacent panels or frame retaining sleeves. A plurality of control strings 224 are attached to one panel and frame member set, such as 218. A plurality of openings 226 are provided along the same panel and frame member set 218 to allow air to flow into the enclosed space 228. Thus, air can be flowed through the openings 226 or through the open ends 227, 229 into the enclosed space 228 during use to cause the flying structure 210 to get airborne and to float in the sky.

To fold and collapse the flying structure 210, the panel and frame member sets 212 and 214 may be pressed against the panel and frame member sets 218 and 216, respectively, about the respective hinged connections between the adjacent panel and frame member sets. The combined stack of panel and frame member sets 212 and 218 are then folded about the hinged connections onto the combined stack of panel and frame member sets 214 and 216 to form a stack of four panel and frame member sets 216, 214, 212 and 218 (in one possible order). The combined stack of panel and frame member sets 212, 214, 216 and 218 can then be folded and collapsed according to the method described above in FIGS. 3A–3D. Alternatively, if the hinged connections are detachable, it is also possible to separate one or more of the panel and frame member sets, and then place the separated panel and frame member sets one on top of the other so that the combined stack of panel and frame member sets 212, 214, 216, 218 can then be folded and collapsed according to the method described above in FIGS. 3A–3D.

To open and assemble the flying structure 210, the collapsed stack of panel and frame member sets 212, 214, 216, 218 is opened in the manner described above so that all the frame members are opened to their expanded configurations. The panel and frame member sets are then unfolded about the hinged connections to reach the configuration illustrated in FIG. 10, where the flying structure 210 is ready for use. If the panel and frame member sets have been detached, they can then be re-attached to form the configuration illustrated in FIG. 10.

Figure 11:
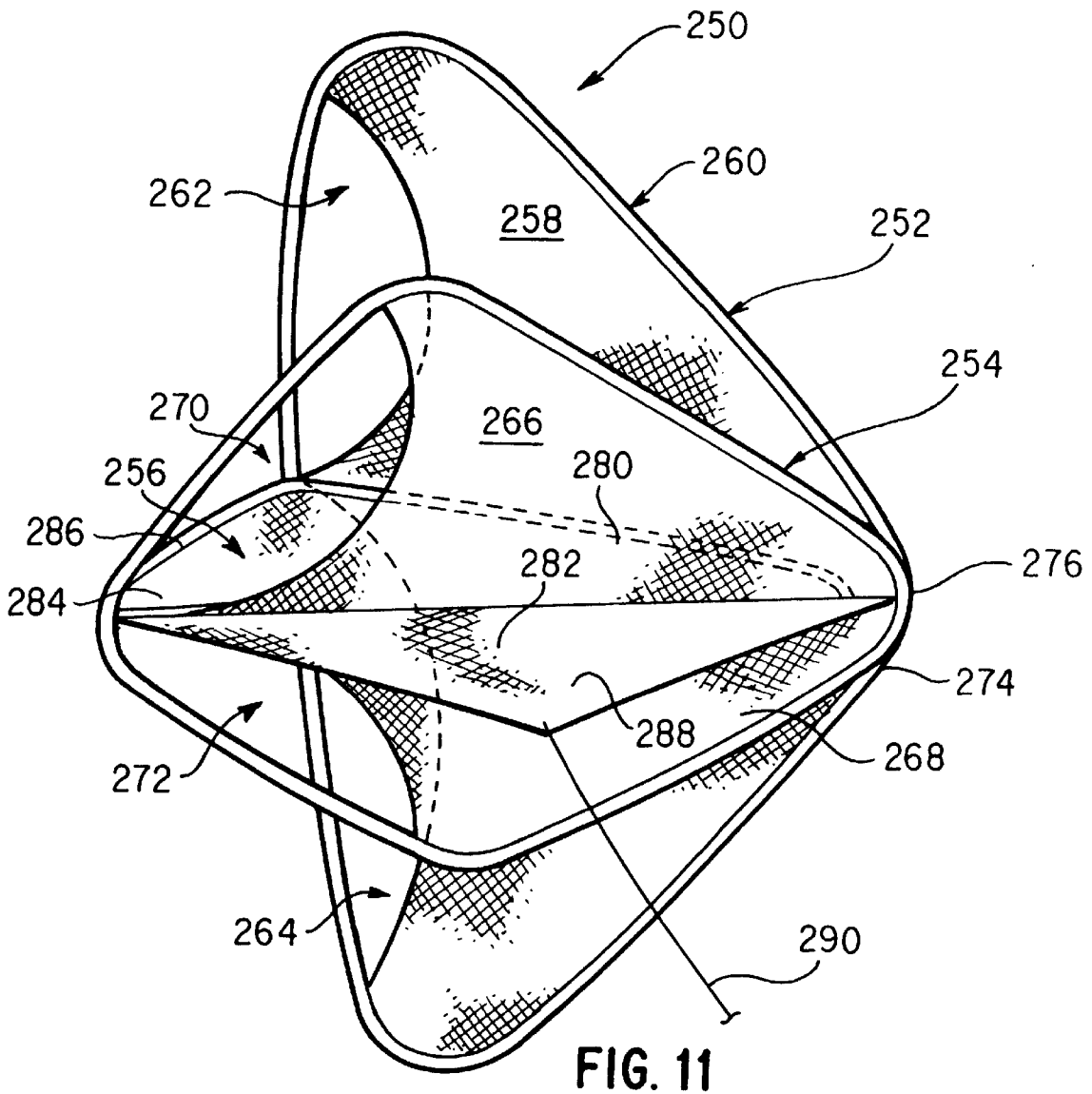
FIG. 11 is a perspective view of a collapsible flying structure according to a ninth preferred embodiment of the present invention shown in use in its expanded configuration.

FIG. 11 illustrates yet a further flying structure 250 according to the present invention. The flying structure 250 has two panel and frame member sets 252 and 254 separated by a supporting panel and frame member set 256. A first panel and frame member set 252 has a generally triangular configuration, and includes a panel 258 with a continuous frame retaining sleeve 260 provided along and traversing most of the edges of the panel 258, except for two openings 262 and 264. The openings 262 and 264 are similar to openings 27, 29 in FIG. 1 and 133, 135 in FIG. 7 and perform the same functions. A continuous frame member (not shown) is retained or held within the frame retaining sleeve 260 to support the panel 258. A second panel and frame member set 254 has a generally diamond-like configuration, and includes a panel 266 with a continuous frame retaining sleeve 268 provided along and traversing most of its edges, again except for two openings 270 and 272. Another continuous frame member (not shown) is retained or held within the frame retaining sleeve 268 to support the panel 266. A corner 274 of the second panel and frame member set 254 is hingedly connected to a corner 276 of the first panel and frame member set 252, using one of the hinged connections described above.

A supporting panel and frame member set 256 separates the first and second panel and frame member sets 252, 254. The supporting panel and frame member set 256 has a generally triangular configuration with a first long side 280 (shown in phantom) and a second long side 282. Both the long sides 280 and 282 have an end that terminate at the connection at the corners 274, 276, and extend away from the corners 274, 276 at an angle with respect to each other. The supporting panel and frame member set 256 also has a panel 284 with a continuous frame retaining sleeve 286 provided along and traversing the edges of the panel 284, with a continuous frame member (not shown) retained or held within the frame retaining sleeve 286 to support the panel 284. The first long side 280 is connected to a central portion of the panel 258 of the first panel and frame member set 252, and the second long side 282 is connected to a central portion of the panel 266 of the second panel and frame member set 254. At least one of the first or second long sides 280 or 282 is permanently and hingedly attached (such as by stitching) to the corresponding panel 258 or 266, respectively, with the other of the first or second long sides 280 or 282 being removably attached (using one of the removable connection mechanisms described above) to the other corresponding panel 258 or 266, respectively. In this embodiment, let us assume that the first long side 280 is permanently and hingedly attached to the panel 258, with the second long side 282 removably attached to the panel 266. It is also possible that both the first and second long sides 280, 282 are removably attached. Thus, the supporting panel and frame member set 256 acts to separate the first and second panel and frame member sets 252, 254 in a manner similar to the opening of the two shells of a clam. In this configuration, the supporting panel and frame member set 256 is positioned generally perpendicular to the first and second panel and frame member sets 252 and 254.

In addition, a control panel 288 is attached to a side of the panel 266 opposite from the side to which the second long side 282 is connected. It is possible to provide the control panel 288 with a supporting frame member, or to omit the frame member. A control string 290 is attached to the control panel 288 for manipulation by the user.

To fold and collapse the flying structure 250, the connection between the panel and frame member sets 254 and 256 along the second long side 282 is first detached. The panel and frame member set 256 is then folded against the panel and frame member set 252 about the hinged connection of the first long side 280. Thereafter, the panel and frame member set 254 is folded against the combined stack of panel and frame member sets 252 and 256 about the hinged connection at the corners 274, 276. The combined stack of panel and frame member sets 252, 254 and 256 can then be folded and collapsed according to the method described above in FIGS. 3A–3D.

Alternatively, if the first long side 280 is removably attached to the panel 258, with the second long side 282 permanently and hingedly attached to the panel 266, the connection between the panel and frame member sets 252 and 256 along the first long side 280 is first detached. The panel and frame member set 256 is then folded against the panel and frame member set 254 about the hinged connection of the second long side 282. Thereafter, the panel and frame member set 252 is folded against the combined stack of panel and frame member sets 254 and 256 about the hinged connection at the corners 274, 276. The combined stack of panel and frame member sets 252, 254 and 256 can then be folded and collapsed according to the method described above in FIGS. 3A–3D.

As a further alternative, if both the first and second long sides 280, 282 are removably attached, it is possible to first completely detach the panel and frame member set 256, then fold panel and frame member set 254 onto panel and frame member set 252, and place panel and frame member set 256 onto the combined stack of panel and frame member sets 252, 254, before twisting and folding the combined stack of panel and frame member sets 252, 254 and 256 according to the method described above in FIGS. 3A–3D.

To open and assemble the flying structure 250, the collapsed stack of panel and frame member sets 252, 254, 256 is opened in the manner described above so that all the frame members are opened to their expanded configurations. The panel and frame member sets 252, 254 are unfolded about the hinged connection at corners 274, 276, and the removable attachments along either or both the first or second long side 280 or 282 are then reattached to reach the configuration illustrated in FIG. 11, where the flying structure 250 is ready for use.

Although the various embodiments of the present invention have been illustrated as having one or more control panels 40, 62, 64, 66, 68, 70, 40*a*, 40*b*, 136, 138, 140, 162, 164, 166, 176, 178, 180, and 288, these control panels can be omitted, with the control strings 42, 63, 65, 67, 69, 71, 42*a*, 42*b*, 42*c*, 148*a*, 148*b*, 150*a*, 150*b*, 177, 179, 181, 224, and 290 directly attached to these panels of the flying structures to control the flight of the various flying structures 20, 60, 100, 120, 130, 160, 170, 210 and 250. Each of these control panels can be provided with or without supporting frame members.

In addition, although the frame members and panels of the various embodiments are described hereinabove as having specific configurations, it is possible to provide these frame members and panels in any shape or size, and to vary the shapes and sizes of the panel and frame member sets of a particular flying structure.

Thus, the flying structures according to the present invention may be provided in a variety of configurations in which the number of basic structures and the shape and size of the separate panels may be varied. Some of the flying structures of the present invention can even be disassembled to create a plurality of different flying structures. These features add variety and entertainment value. The flying structures according to the present invention can be easily deployed and disassembled, and are easy to fold and collapse into a compact configuration for convenient storage and transportation.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A flying structure, comprising:

an enclosed resilient frame member having a folded and an unfolded orientation, the frame member being coilable and having a natural bias which biases it to the unfolded orientation;

a panel covering a portion of the resilient frame member to form the flying structure when the frame member is in the unfolded orientation; and a control string coupled to the panel for controlling the flight of the flying structure;

wherein the frame member and panel may be twisted and folded to form a plurality of concentric loops and panels in the folded orientation of the frame member to substantially reduce the size of the flying structure, with the natural bias operating to cause the frame member to spring open to the unfolded orientation when the frame member is unfolded from the folded orientation.

2. The structure of claim 1, further including at least one control panel attached to the panel and coupling the control string with the panel.

3. The structure of claim 2, wherein one of the at least one control panels includes an enclosed resilient frame member having a folded and an unfolded orientation, with the control panel substantially covering the resilient frame member when the frame member is in the unfolded orientation.

4. The structure of claim 1, further including a frame retaining sleeve for housing the frame member, with the panel attached to the frame retaining sleeve.

5. The structure of claim 1, further including at least one opening defined between the panel and the frame member.

6. The structure of claim 1, further comprising:

an enclosure attached to the panel, the enclosure comprising two side walls attached to the panel, and a bottom wall attached to the two side walls; and at least one opening provided on the panel and communicating with the enclosure.

7. The structure of claim 1, wherein each frame member may be repeatedly folded to the folded orientation and then subsequently unfolded to the unfolded orientation.

8. A flying structure, comprising:

first and second structures, each of the first and second structures comprising:

an enclosed resilient frame member having a folded and an unfolded orientation, the frame member being coilable and having a natural bias which biases it to the unfolded orientation; and a panel covering a portion of the resilient frame member when the frame member is in the unfolded orientation;

a connector for connecting the first and second structures; and wherein the first structure may be placed on top of the second structure when their frame members are in the unfolded orientation to form a stack of first and second structures, and wherein frame members and panels of the stack of first and second structures may be twisted and folded to form a plurality of concentric loops and panels in the folded orientation of the frame members to substantially reduce the sizes of the first and second structures, with the natural bias operating to cause the frame members to spring open to the unfolded orientation when the frame members are unfolded from the folded orientation.

9. The structure of claim 8, wherein the connector is detachable so that the first and second structures can be separated.

10. The structure of claim 9, wherein the connector is a connector piece having a first end attached to the first structure and a second end attached to the second structure.

11. The structure of claim 8, wherein each of the first and second structures further includes a frame retaining sleeve for housing the frame member, with the panel attached to the frame retaining sleeve.

12. The structure of claim 11, wherein the connector comprises a stitching that is applied to the frame retaining sleeves of the first and second panels.

13. The structure of claim 8, wherein the connector operates as a hinge to allow the first structure to be folded upon the second structure about the connector.

14. The structure of claim 8, wherein the first and second structures each further includes a control panel attached to the panel and coupling the control string with the panel.

15. The structure of claim 8, wherein the connector comprises a plurality of threads attaching the panels of the first and second structures so that a space is defined between the panels of the first and second structures when the flying structure is in use.

16. The structure of claim 8, further including a control string coupled to one of the panels for controlling the flight of the flying structure.

17. The structure of claim 8, further including at least one opening defined between each panel and frame member.

18. The structure of claim 8, further including a third structure, the third structure comprising:

an enclosed resilient frame member having a folded and an unfolded orientation;

a panel covering a portion of the resilient frame member when the frame member is in the unfolded orientation;

a first side and a second side;

wherein the first side of the third structure is coupled to the panel of the first structure, and the second side of the third structure is coupled to the panel of the second structure.

19. The structure of claim 18, wherein the third structure is positioned generally perpendicular to the first and second structures.

20. The structure of claim 18, wherein at least one of the first and second sides is removably attached to the panel of one of the first structure or the second structure.

21. The structure of claim 8, wherein each frame member may be repeatedly folded to the folded orientation and then subsequently unfolded to the unfolded orientation.

22. A method for folding and collapsing a flying structure, comprising:

(a) providing a flying structure having:

(i) first and second structures, each of the first and second structures comprising:

an enclosed resilient frame member having a folded and an unfolded orientation, the frame member being coilable and having a natural bias which biases it to the unfolded orientation; and a panel covering a portion of the resilient frame member when the frame member is in the unfolded orientation;

(ii) a connector for connecting the first and second structures;

(b) forming a stack of first and second structures by placing the first structure on top of the second structure when their frame members are in the unfolded orientation;

(c) reducing the sizes of the first and second structures by twisting and folding the frame members and panels of the stack of first and second structures to form a plurality of concentric loops and panels in the folded orientation of the frame members; and (d) causing the frame members to spring open to the unfolded orientation when the frame members are unfolded from the folded orientation.

23. The method of claim 22, wherein step (b) further includes the step of folding the first structure about the connector operating as a hinge to place the first structure on top of the second structure.

24. The method of claim 22, wherein step (b) further includes the step of detaching the first and second structures.

25. The method of claim 22, further comprising:

(e) twisting and folding the frame members and panels of the stack of first and second structures to form a plurality of concentric loops and panels in the folded orientation of the frame members.

26. The method of claim 22, wherein causing the frame members to spring open to the unfolded orientation when the frame members are unfolded from the folded orientation is accomplished by the natural bias of the frame members.

27. A flying structure, comprising:

at least first, second and third structures, each of the first, second and third structures comprising:

an enclosed resilient frame member having a folded and an unfolded orientation;

a panel covering the resilient frame member when the frame member is in the unfolded orientation; and a first side and a second side;

wherein the first side of each of the structures is hingedly connected with the second side of another of the structures so that all the structures are connected together to form an enclosed space; and wherein each structure may be placed on top of another structure when their frame members are in the unfolded orientation to form a stack of structures, and wherein frame members and panels of the stack of structures may be twisted and folded to form a plurality of concentric loops and panels in the folded orientation of the frame members, to substantially reduce the sizes of the structures.

28. The structure of claim 27, wherein at least one opening is provided on one of the panels to communicate air to the enclosed space.

* * * * *